US010918182B2

(12) United States Patent
Voeva-Kolev

(10) Patent No.: US 10,918,182 B2
(45) Date of Patent: Feb. 16, 2021

(54) HAIR ROLLER

(71) Applicant: Elitza Danielova Voeva-Kolev, Silver Spring, MD (US)

(72) Inventor: Elitza Danielova Voeva-Kolev, Silver Spring, MD (US)

(73) Assignee: Bukli Haircare, Silver Spring, MD (US)

( * ) Notice: Subject to any disclaimer, the term of this patent is extended or adjusted under 35 U.S.C. 154(b) by 584 days.

(21) Appl. No.: 14/696,320

(22) Filed: Apr. 24, 2015

(65) Prior Publication Data

US 2016/0309869 A1 Oct. 27, 2016

(51) Int. Cl.

| | |
|---|---|
| ***A45D 2/02*** | (2006.01) |
| ***A45D 2/08*** | (2006.01) |
| ***A45D 7/00*** | (2006.01) |
| *A45D 2/24* | (2006.01) |
| *A45D 2/14* | (2006.01) |
| *A45D 2/18* | (2006.01) |

(52) U.S. Cl.

CPC ..... *A45D 2/02* (2013.01); *A45D 2/08* (2013.01); *A45D 7/00* (2013.01); *A45D 2/145* (2013.01); *A45D 2/146* (2013.01); *A45D 2/18* (2013.01); *A45D 2/2478* (2013.01); *A45D 2007/002* (2013.01)

(58) Field of Classification Search

CPC ..... A45D 2/02; A45D 2/122; A45D 2/125; A45D 2/127; A45D 2006/005; A45D 6/00; A45D 6/02; A45D 7/00; A45D 2007/004; A45D 2007/002; A45D 2/2478; A45D 2/22; A45D 2/18; A45D 2/16; A45D 2/148; A45D 2/146; A45D 2/08; A45D 2/06; A45D 2/04

See application file for complete search history.

(56) References Cited

U.S. PATENT DOCUMENTS

| | | | | |
|---|---|---|---|---|
| 1,673,022 A * | 6/1928 | Sexton | A45D 7/00 132/211 |
| 3,204,646 A | 9/1965 | Chamberlin | |
| 3,367,345 A * | 2/1968 | Riley | A45D 2/001 132/207 |
| 3,395,790 A * | 8/1968 | Smith | A45D 2/146 132/261 |
| 3,404,694 A * | 10/1968 | Hammel | A45D 2/148 132/251 |
| 3,419,018 A | 12/1968 | Nathan | |
| 3,540,457 A | 11/1970 | Solomon | |

(Continued)

FOREIGN PATENT DOCUMENTS

| | | |
|---|---|---|
| FR | 2663518 | 12/1991 |

OTHER PUBLICATIONS

Merriam Webster definition of "hook" accessed Apr. 16, 2019 https://www.merriam-webster.com/dictionary/hook.*

*Primary Examiner* — Yogesh P Patel
*Assistant Examiner* — Jennifer Gill
(74) *Attorney, Agent, or Firm* — Ryan Alley IP

(57) ABSTRACT

A dual member hair roller device designed to produce spiral curls for hair lengths that vary from medium short to very long and comprised of a flexible, permeable, elongated supporting roller body with a lateral surface that is capable of gripping fabric; and a detached, elastic, permeable fabric sleeve that safely and securely affixes to the gripping surface of the roller body.

6 Claims, 7 Drawing Sheets

(56) References Cited

U.S. PATENT DOCUMENTS 3,590,829 A * 7/1971 Parisi ..... A45D 2/127 132/226
4,002,180 A * 1/1977 Maier ..... A45D 2/02 132/248
4,211,245 A 7/1980 Coppola et al.
4,502,496 A 3/1985 Thomas et al.
5,538,021 A * 7/1996 Kim ..... A45D 2/12 132/222
5,662,128 A * 9/1997 Habibi ..... A45D 2/14 132/203
5,826,596 A 10/1998 Brenn-Albertoni
5,901,711 A * 5/1999 Jeremy ..... A45D 2/362 132/212
5,944,029 A * 8/1999 Brenner ..... A45D 2/18 132/203
6,006,759 A * 12/1999 Goodwin ..... A45D 2/127 132/250
6,012,466 A * 1/2000 Apanasewicz ..... A45D 2/2478 132/212
6,092,373 A 7/2000 Mundinger
6,092,534 A * 7/2000 Cheung ..... A45D 2/362 132/212
6,119,703 A * 9/2000 Santhouse ..... A45D 2/2478 132/262
6,161,553 A * 12/2000 Lytle ..... A45D 2/10 132/210
D439,373 S 3/2001 Cheung
6,415,801 B1 * 7/2002 Gallegos ..... A45D 2/24 132/251
6,443,163 B1 9/2002 Merges
6,443,193 B1 9/2002 Blasco
D469,924 S 2/2003 Farrell
2006/0130866 A1 * 6/2006 Shimomura ..... A45D 2/2464 132/226
2010/0252062 A1 * 10/2010 Gregorek ..... A45D 2/122 132/200
2010/0252063 A1 * 10/2010 Grossman ..... A61C 15/043 132/200
2013/0269724 A1 * 10/2013 Hu ..... A45D 2/12 132/252

* cited by examiner

HAIR ROLLER

RELATED APPLICATIONS

U.S. Pat. Nos. 3,204,646A; 3,419,018A; 3,540,457A; 4,002,180A 4,502,496A; 5,826,596A; 5,901,71100; 6,006,759A; 6,092,373A; U.S. D439,373S; U.S. Pat. No. 6,443,193B1; U.S. D469,924S; FR 2663518; IT 4,211,245.

BACKGROUND OF THE INVENTION

The herein invention relates to the field of personal hair accessories intended to curl human hair.

Hair curling technologies have long strived to pioneer easy to install, comfortable and reliable hair rollers. Current hair rollers do not adequately secure the hair to the roller, are uncomfortable during overnight wear, do not produce spiral curves with relatively consistent radius, and do not facilitate hair drying if damp hair is wound around them. Furthermore, current hair rollers have finite dimensions that limit the amount of hair that can be wound around them. As a consequence, large tresses of hair may not curl as expected because excess of hair may be placed on the roller.

Elongated cylindrical foam rollers that are readily available in the marketplace claim to create spiral curls or waves. They secure the hair by bending the roller's ends on top of the hair after it is wound. A hair roller known from US patent document No. 6006759 has a similar elongated body as the commonly used foam rollers, however, instead of bending ends it employs the use of a non-elastic ribbon-type fastener which is secured through spiral slits at the end of the body. This hair roller is also designed to create spiral curls. A major shortcoming of both types of rollers is that the wound up hair unravels easily during physical activity or overnight wear. Another drawback is that it may not be possible for a long tress of hair to be wound around the cylindrical body in a spiral fashion because of the roller's finite length. As a result, long tresses have a higher likelihood to be placed on top of previously rolled hair, thus foregoing the spiral curl effect. What is more, if a long tress of hair is wound up damp, the hair from the outer sections prevents moisture escape from the inner sections of hair.

A hair curler known from US patent document No. 6443163 consists of a supporting body with cross-section that diminishes from one end to the other and a pin-like fixing device. This type of curler is designed to prevent hair from slipping and to produce spiral curls with diminishing bending radius. Nevertheless, the roller is uncomfortable for overnight wear due to its rigid supporting body.

A hair roller known from US patent document No. D469924S consists of a rigid cylindrical supporting body made of plastic and covered in hook, fabric-gripping fabric material. Problems associated with curling hair with this device include discomfort during overnight wear, difficulty removing hair that gets tangled into the hair retention surface of the roller, and static electricity build-up caused by removing the hair from the gripping surface of the roller. Furthermore, all short cylindrical hair rollers by design lead to the winding of one section of hair on top of another. As a consequence, if damp hair is wound up around the roller, it is difficult for moisture to leave the inner sections of the hair.

BRIEF SUMMARY OF THE INVENTION

The present invention introduces a dual member hair accessory which facilitates the curling of hair and surmounts the issues associated with currently known hair rollers. The purpose the invention is to create a hair roller which allows for uncomplicated and secure winding of wet or dry hair, is comfortable, and produces relatively spiral curls.

The first member of the present hair roller assembly is a light-weight, flexible, elongated supporting roller body with a lateral surface that has a plurality of projections with hooked shaped ends capable of gripping fabric. The second member of the present invention is a stretchable, permeable fabric sleeve. A tress of hair is passed through the sleeve, which in turn is repeatedly wrapped around the supporting roller body in a downward spiral fashion. The sleeve securely attaches to the hooked, fabric-gripping surface of the roller and prevents the hair from unwinding.

A major benefit of the present invention is that it is more comfortable to wear while sleeping because the flexible nature of the supporting roller can be easily pressed or bent when weight is applied to it. Once the weight is removed, the roller body reverts to its original shape.

The elongated body of the supporting roller encourages the winding of hair in a downward spiral fashion. As a result, after removal from the hair the present roller produces spiral curves. In addition, multiple supporting roller members can be attached to one another via their fabric-gripping exteriors in order to create new, longer or wider roller bodies that allow for customization of the wave radius and ensure that the spiral curl effect is present in long tresses of hair.

Another major benefit of the present invention is the incorporation of an elastic fabric sleeve member which envelops the tresses of hair that are being curled. The sleeve acts as a fastening mechanism owing to its secure attachment to the roller member by clenching to the roller's gripping outer surface. Furthermore, due to its fabric nature, the sleeve does not leave indentations in the hair after it has been unwound unlike other hair curlers that employ the use of rigid securing mechanisms such as pins, brackets, or clips. Another benefit of the elastic sleeve is that it shields the hair from the roller, thus reducing static electricity build-up which may result from the friction between the hair and roller's gripping surface.

In the event of damp hair being wound up around the present hair roller, the liquid and gas permeability of both the supporting body and the fabric sleeve member provide a pathway for moisture to leave the hair, thus enhancing the hair drying capabilities of the roller.

BRIEF DESCRIPTION OF THE SEVERAL VIEWS OF THE DRAWING

The components of the invention herein are not drawn to scale. It is an object of the drawings to illustrate the primary functions of the present hair roller assembly by utilizing several views and reference numbers designating corresponding parts.

DETAILED DESCRIPTION OF THE INVENTION

An exemplary embodiment of the invention is illustrated in greater detail in FIGS. 1-8. The embodiment presented is not to be construed as limiting the invention thereto.

Figure 1:
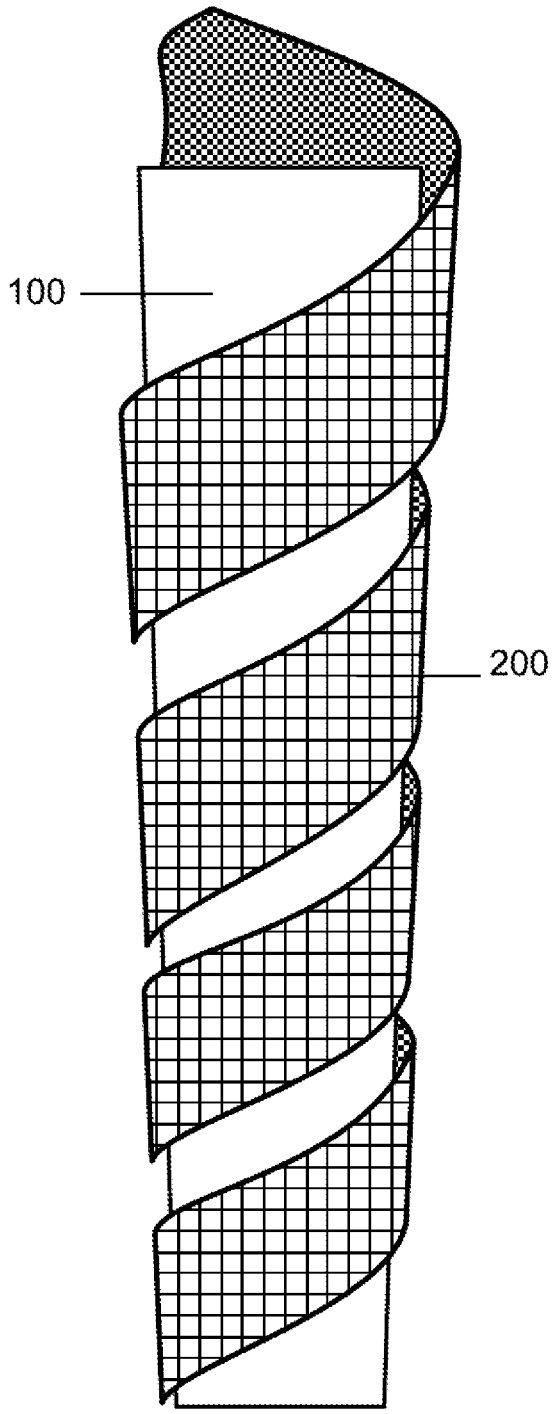
FIG. 1 is an isometric view of the hair roller assembly, illustrating the relationship between the supporting roller member 100 and the elastic fabric sleeve member 200.

A specific example of a preferred embodiment of the hair roller device is depicted in FIG. 1. The drawing demonstrates the composite assembly of the partnering members of the present hair roller in which the sleeve member 200 is wound around the roller member 100 in a spiral fashion. It should be understood that first a tress of hair has been passed through sleeve member 200. The tress, together with the sleeve member 200, is jointly wound along roller member 100 in a spiral manner. Accordingly, roller member 100 is constituted to be the supporting roller member of the present hair roller ensemble.

Figure 2:
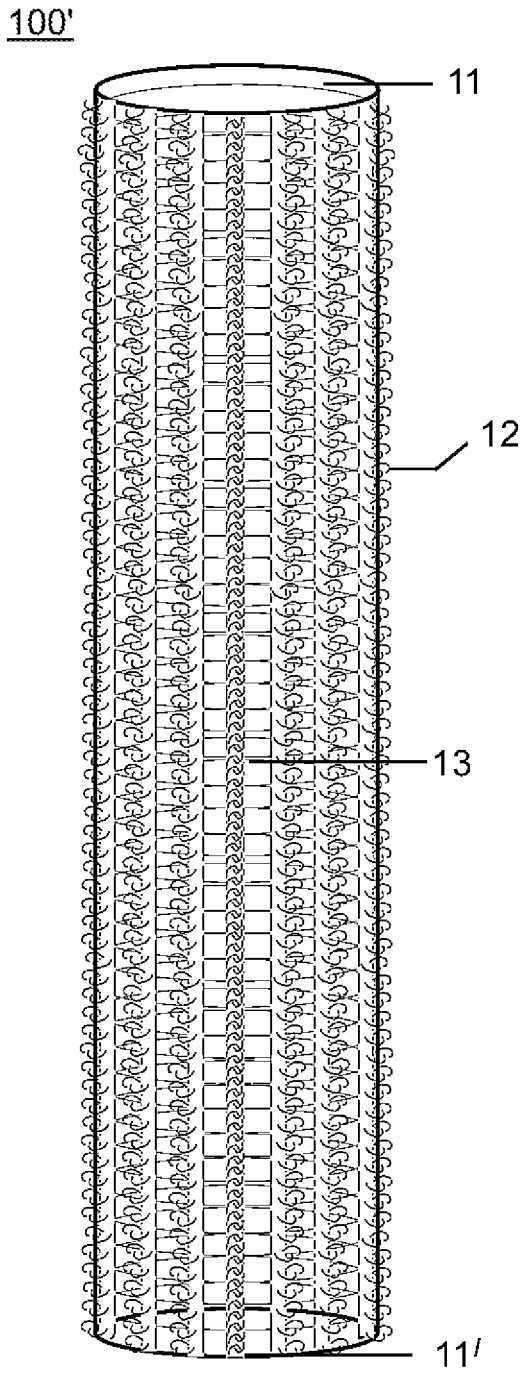
FIG. 2 is a perspective view of an exemplary cylindrically shaped embodiment of the supporting roller member 100'.
Figure 3:
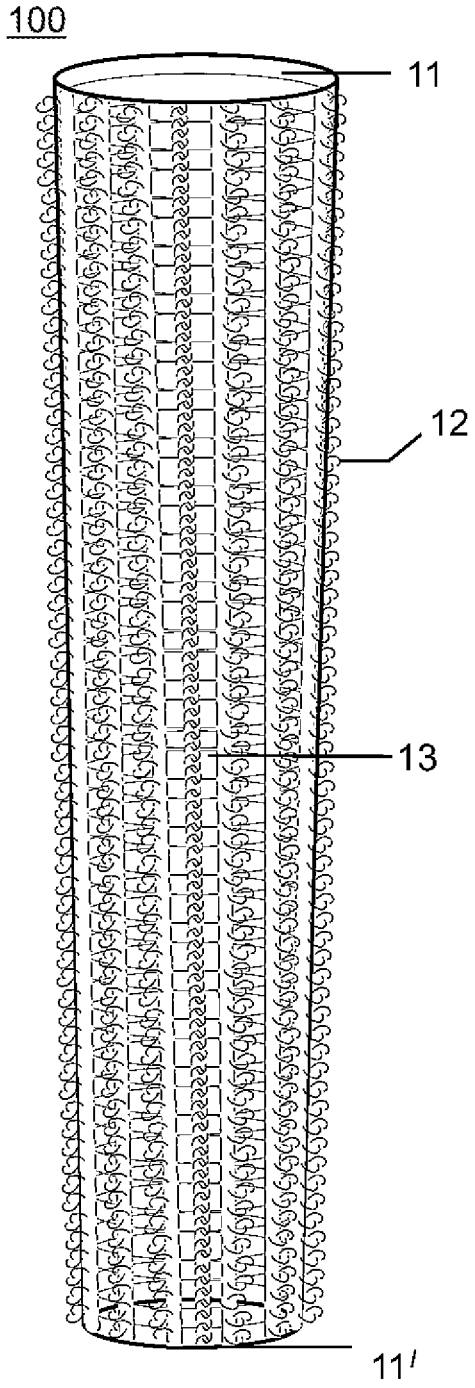
FIG. 3 is a perspective view of an exemplary right frustum shaped embodiment of the supporting roller member 100.
Figure 3A:
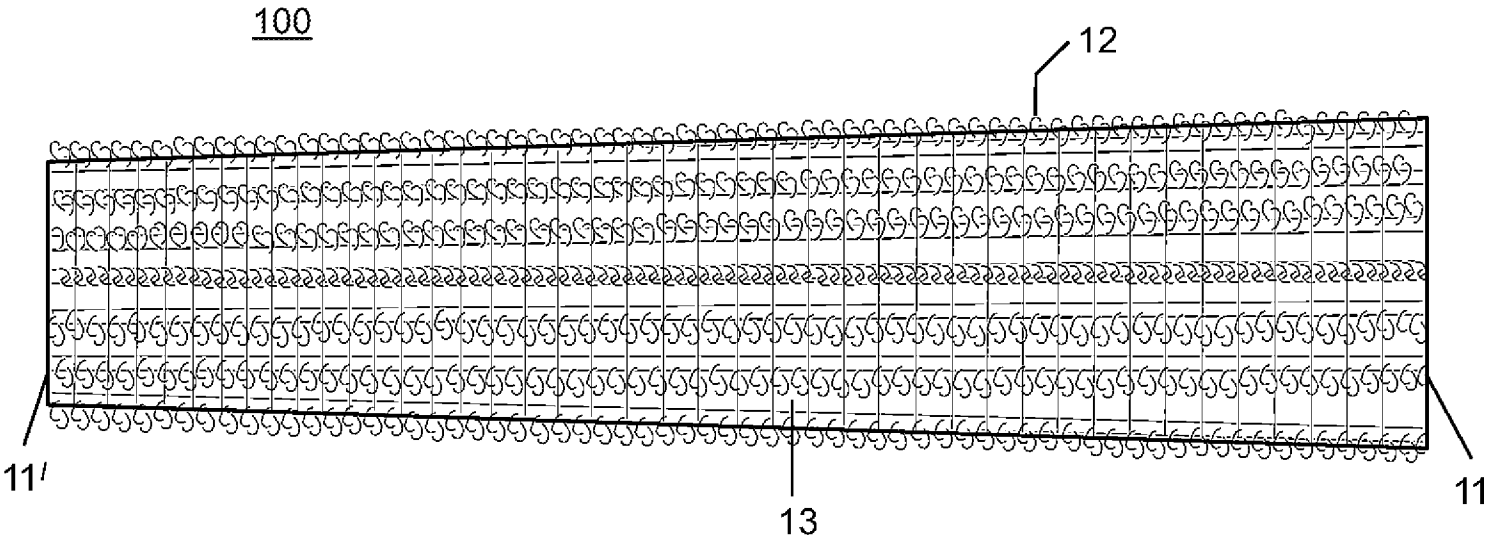
FIG. 3A is a side view of the supporting roller member of FIG. 3.
Figure 4:
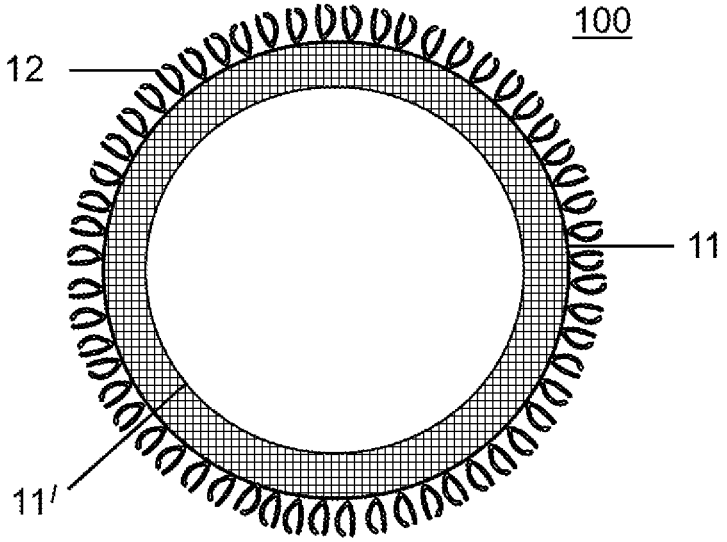
FIG. 4 is an end view of the supporting roller member 100 as shown in FIG. 3.
Figure 5:
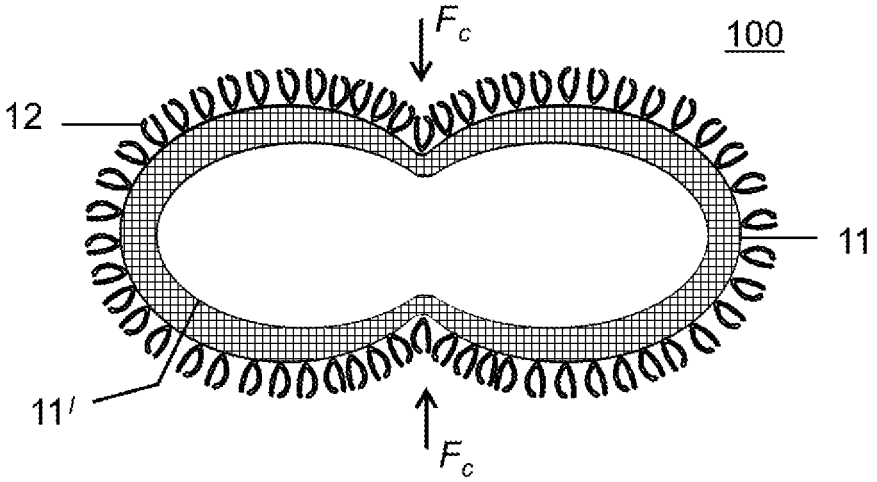
FIG. 5 is an end view of the supporting roller member 100, as shown in FIG. 3, that demonstrates the bendable properties of the roller body as a compression force, FC, is applied to its surface.

In terms of greater detail, an embodiment of the supporting roller member 100 of FIG. 1 is shown in FIGS. 3-5. In FIG. 2, one preferred form of the roller member 100' may be generally characterized as an elongated, right cylinder. The cylinder embodiment shown in FIG. 2 is hollow. A second preferred form of the roller member 100 may be generally characterized as an elongated, right conical frustum. The frustum embodiment shown in FIGS. 3-5 is also hollow. The supporting roller member 100 has two opposite ends 11 and 11', a circumference, and an approximately circular or elliptical cross section with a diameter that may stay constant as viewed in FIG. 2 or may increase from one end along the axial length of the roller towards the other end as viewed in FIGS. 3-5. The supporting roller member 100 may or may not be hollow. The outer periphery of the roller is covered with plurality of flexible projections 12. Each projection 12 has a hooked shaped end which is capable of gripping fabric. The fabric-gripping hooks as projections 12 act as multiple attachment mechanisms that easily and securely connect the supporting roller member 100 to the sleeve member 200.

The embodiment of the supporting roller member 100 is made of light-weight material that has plurality of apertures 13 so that it is porous and allows the movement of air, liquids, and water vapor through it. As illustrated in FIG. 5, the supporting roller member is also made of soft material that possesses sufficient flexibility and resilience. When a compression force, Fc, is exerted at the sides of the roller member 100, for example when the weight of a head is applied to the roller when lying on a pillow or another resting surface, the roller walls bend under that force. Furthermore, the roller member 100 reverts to its original shape after removal of the stress. The distinctive combination of the flexible frame, the fabric-gripping exterior, and the permeable, elongated shape characterize the improvements of the supporting roller member 100 over all of the currently known hair rollers.

Figure 6:
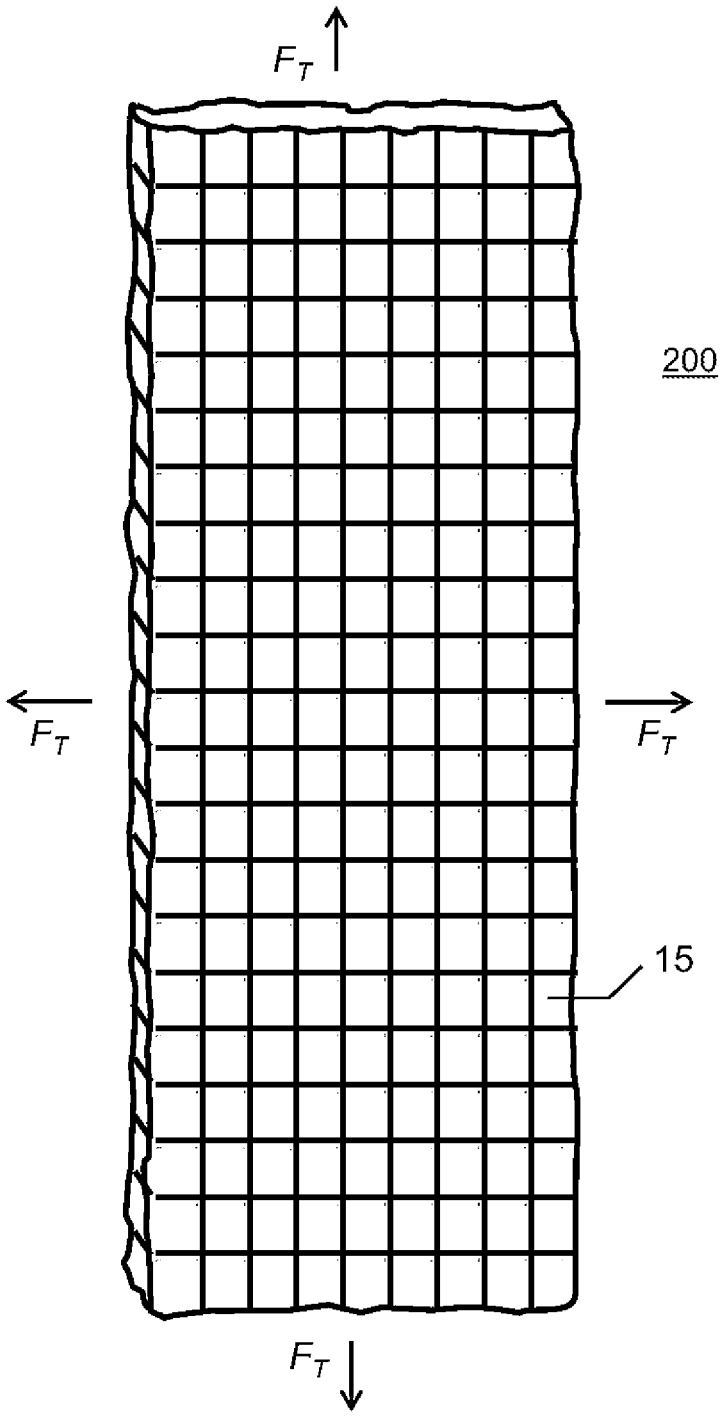
FIG. 6 is a perspective view illustrating an exemplary embodiment of the tubular fabric sleeve member 200 and its elastic properties as a tensile force, FT, is exerted by each end of the sleeve.
Figure 7:
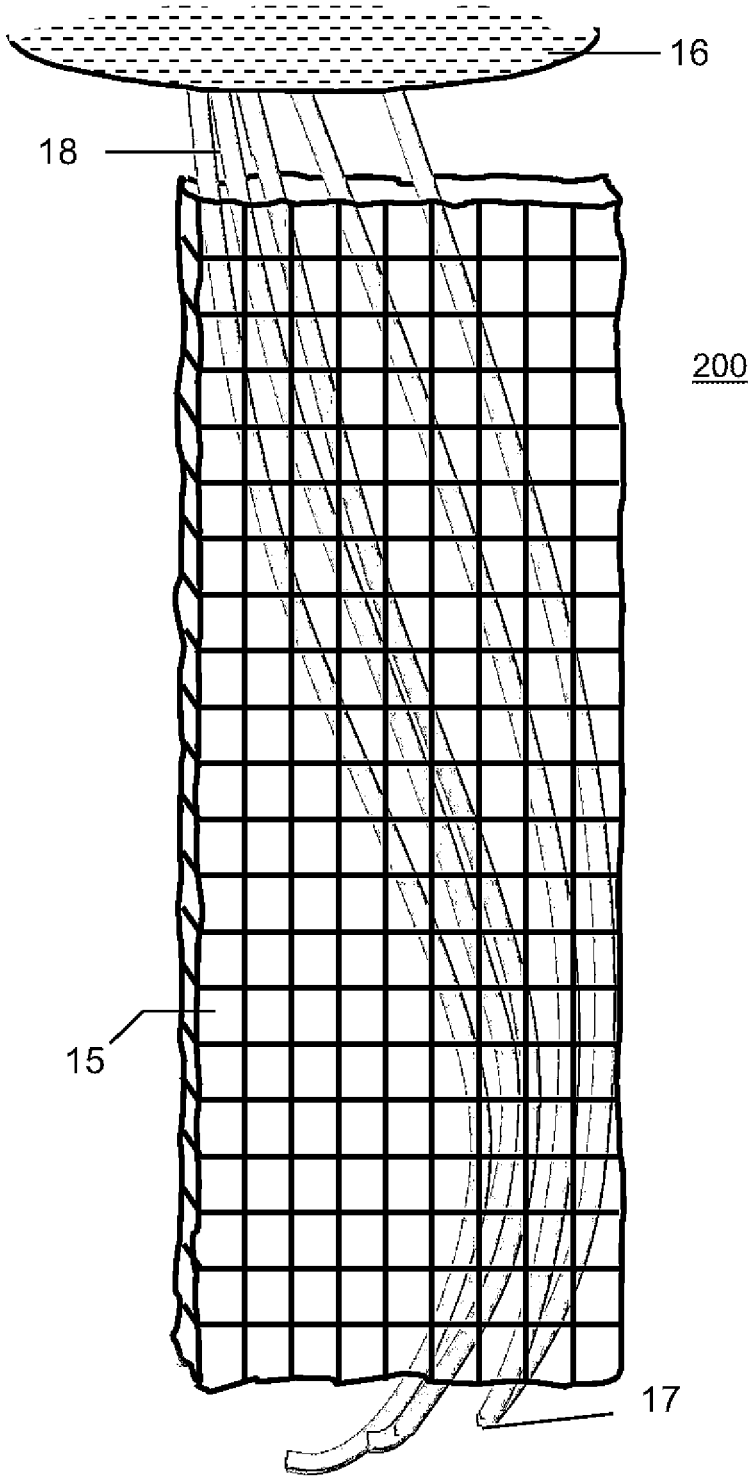
FIG. 7 is a perspective view illustrating an exemplary embodiment of the tubular fabric sleeve member 200 and a tress of hair that has been passed through it.
Figure 8B:
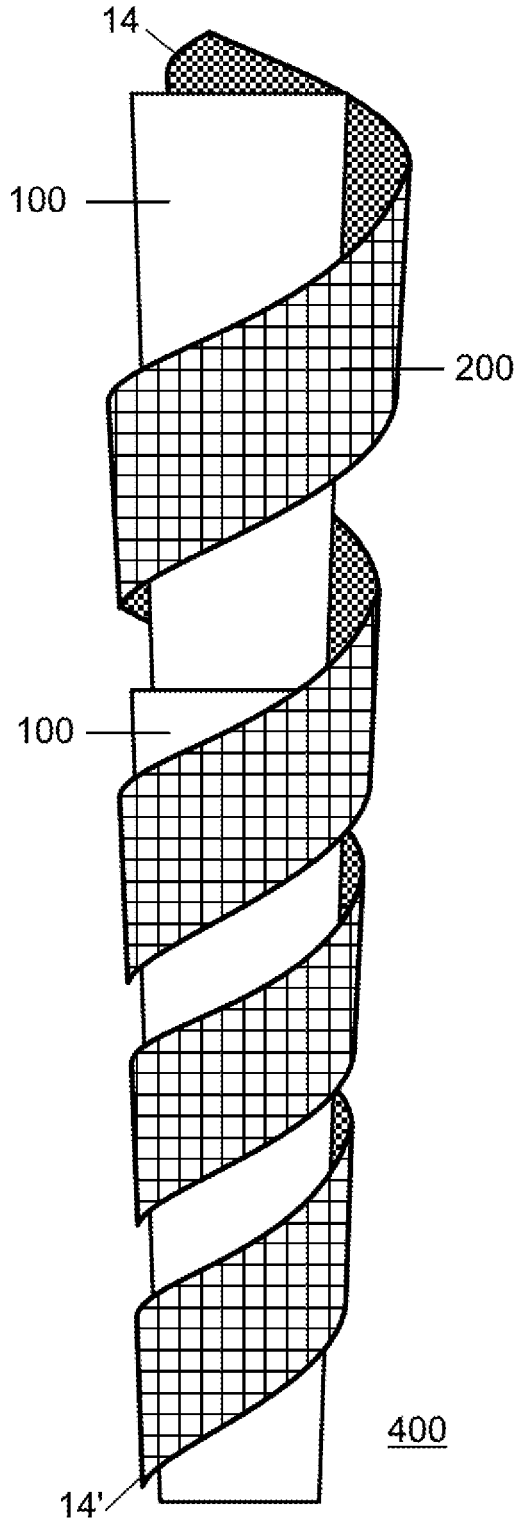
FIG. 8B is an isometric view of the hair roller assembly of the present invention that depicts another alternative arrangement of the supporting roller member 100 and the fabric sleeve member 200.
Figure 8A:
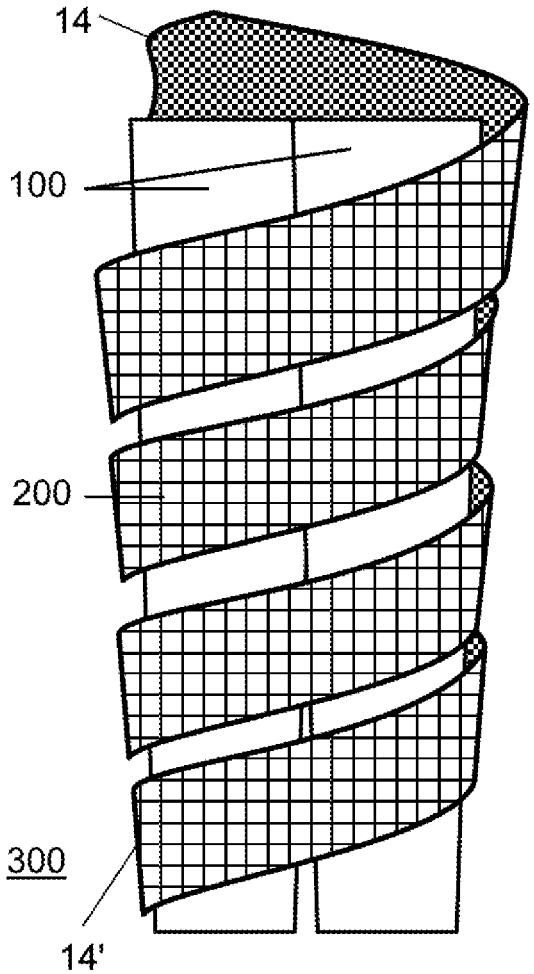
FIG. 8A is an isometric view of the hair roller assembly of the present invention that depicts an alternative arrangement of the supporting roller member 100 and the fabric sleeve member 200.

In terms of greater detail, an embodiment of the sleeve member 200 of FIG. 1 is shown in FIGS. 6-7. The preferred form of the sleeve member may be generally characterized as tube with two open ends 14 and 14' (FIGS. 8A & 8B). It should be understood that the sleeve's ends 14 and 14' (FIGS. 8A & 8B) are indistinguishable. The sleeve member 200 may be made of knitted, woven, laced, or crocheted type of fabric material that is light weight. The material may have plurality of apertures 15. The yarns of the sleeve fabric may be spaced so that the material has open appearance. The apertures 15 and the sufficiently spaced yarns allow the movement of air, liquids, and water vapor from one side of the fabric to the other. The fabric material is elastic and may have stretch engineered into its yarn through mechanical stretch construction so that when a tensile force, FT, is exerted by each end of the sleeve member as viewed in FIG. 6, the member has the ability to stretch in four directions and to return to its original size and shape after removal of the stress. The fibers of the sleeve yarn may be natural, synthetic, or a combination of both. The fabric sleeve member 200 can easily and securely attach to and detach from the fabric-gripping surface of the roller member 100. The use of a fabric sleeve as an attachment mechanism is a novel element in the hair curling technology and is what distinguishes the present invention from other inventions.

The dual-member hair roller may be installed to the hair as follows:

First, the sleeve member 200 is taken and the fabric is gathered around the installer's fingers to form a scrunched up fabric ring. Second, a tress of hair 18 is taken and, starting with the tips 17, is passed through the ring described above. Once the entire tress of hair 18 goes through the ring, the fabric is slid upwards towards the scalp 16. Next, the fabric is extended back to its original length, or stretched out along its axial length so that in covers more hair surface. When the tress of hair 18 is fully inserted within the fabric sleeve as viewed in FIG. 7, the first end of the sleeve 14 (FIGS. 8A & 8B) is located close to the scalp 16 while the opposite end 14' (FIGS. 8A & 8B) is located close to the hair tips 17. Next, the supporting roller member 100 is taken and moved close to the scalp 16 and the sleeve end 14 (FIGS. 8A & 8B). The supporting roller member 100 is placed in an upright position and is held stationary. The winding process begins by relative rotation of the fabric sleeve member 200 around the roller member 100. Unlike the winding process employed in the case of non-elongated cylindrical hair curlers, the tress of hair herein is wound along the roller member 100 in a spiral manner from one end 11 to the opposite end 11' of the roller. As indicated previously, depending on the embodiment of the preferred form of the roller member 100, the tress of hair 18 may be wound up in a continuous curve of either constant (FIG. 2) or changing (FIG. 3) diameter along the frame of roller member 100. Thus, the tress of hair may have a bending radius that either stays constant or increases or diminishes continuously. The winding process ends when the entire length of the tress of hair 18 within the sleeve member 200 is wound around the roller member 100. The sleeve member 200 and the supporting roller member 100 can be pressed together or pulled apart for easy fastening and unfastening. By enveloping the tress of hair 18, the sleeve member 200 prevents the hair from rubbing against the hooked projections 12 of the roller member 100, thus reducing the build-up of static electricity.

FIGS. 8A and 8B depict two alternative arrangements 300 and 400 of the supporting roller member 100 and the elastic fabric sleeve member 200. The 300 arrangement illustrates an exemplary hair roller constructed by attaching three right conical frustum supporting roller members 100 horizontally to one another via their fabric-gripping exterior walls. The 400 arrangement illustrates an exemplary hair roller constructed by attaching two hollow, right conical frustum supporting roller members 100 vertically to one another via their fabric-gripping exterior walls. The fabric sleeve member 200 is then wound around the two newly constructed supporting bodies. The ability of the supporting roller bodies to interlock by adhering to one another's gripping surfaces is a novel element in the hair curling technology and it makes possible the rolling of very long tresses of hair.

What I claim is:

1. A system for curling hair, the system comprising:

a supporting roller having a surface extending along an axis of the supporting roller;

a tubular sleeve having a length in a longest dimension of the sleeve and two open ends to completely surround a tress of hair inserted into the sleeve through at least one of the open ends, wherein the supporting roller is flexible and porous and the sleeve is flexible and includes a plurality of apertures such that the entire system for curling hair deforms to a shape of a wearer's head when slept on and returns to an original shape when uncompressed while allowing air, liquids, and water vapor to pass through the entire system for curling hair so as to allow drying of the wearer's hair, wherein the sleeve is configured to removably secure to the surface of the supporting roller when the length of the sleeve is wound about the axis of the supporting roller such that the sleeve and the tress inside the sleeve are held in a helical shape about the supporting roller, wherein the surface of the supporting roller is covered with hooks on all sides configured to grip the sleeve upon contact.

2. The system of claim 1, wherein the length of the sleeve is larger than a circumference of the supporting roller so that the sleeve can be angularly wound about the axis of the supporting roller for multiple rotations.

3. The system of claim 2, wherein the supporting roller has a circular cross section with a diameter that changes along the axis such that the helical shape of the tress and the sleeve is spiral.

4. The system of claim 1, wherein the sleeve is a knitted, woven, laced, or crocheted fabric having yarns spaced to form the plurality of apertures.

5. The system of claim 4, wherein the supporting roller has a circular cross section with the hooks completely covering an outer perimeter of the cross section.

6. The system of claim 1, further comprising:

a plurality of the supporting rollers, wherein the plurality of supporting rollers are configured to grip on contact with each other to form a new shape, and wherein the sleeve is configured to removably secure to the surface of each of the plurality of the supporting rollers when the length of the sleeve is angularly wound about the the plurality of the supporting rollers gripped to each other such that the tress is held in the new shape about the supporting rollers.

* * * * *